US008881810B2

(12) United States Patent
Irani et al.

(10) Patent No.: US 8,881,810 B2
(45) Date of Patent: Nov. 11, 2014

(54) DISPERSING SEPARATED HYDROCARBON GAS INTO SEPARATED OIL DURING SURFACE WELL TESTING FOR IMPROVED OIL MOBILITY

(75) Inventors: Cyrus A. Irani, Houston, TX (US); Steven D. Woolsey, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 389 days.

(21) Appl. No.: 13/039,497

(22) Filed: Mar. 3, 2011

(65) Prior Publication Data

US 2012/0222859 A1 Sep. 6, 2012

(51) Int. Cl.
*E21B 43/24* (2006.01)
*E21B 49/00* (2006.01)

(52) U.S. Cl.
CPC ..... *E21B 49/008* (2013.01)
USPC ..... 166/256; 166/267; 166/105.5

(58) Field of Classification Search
None
See application file for complete search history.

(56) References Cited

U.S. PATENT DOCUMENTS 4,429,581 A 2/1984 Furmaga et al.
4,824,447 A * 4/1989 Goldsberry ..... 96/9
4,951,700 A * 8/1990 Kalman ..... 137/174
5,074,357 A * 12/1991 Haines ..... 166/267
5,195,587 A * 3/1993 Webb ..... 166/267
5,211,842 A 5/1993 Tuss et al.
6,491,053 B1 * 12/2002 Briggeman et al. ..... 137/13
6,644,334 B2 * 11/2003 Briggeman ..... 137/13
2008/0283295 A1 * 11/2008 Eia ..... 175/46
2011/0023595 A1 2/2011 Allouche

FOREIGN PATENT DOCUMENTS

WO WO 2009082758 A1 * 7/2009

OTHER PUBLICATIONS

International Search Report and Written Opinion, PCT/US2012/025167, KIPO, Oct. 23, 2012.

* cited by examiner

*Primary Examiner* — Jennifer H Gay
*Assistant Examiner* — Caroline Butcher
(74) *Attorney, Agent, or Firm* — Lawrence R. Youst

(57) ABSTRACT

A surface well testing facility for dispersing separated hydrocarbon gas into separated oil from a multiphase well fluid for improved oil mobility and combustion efficiency. A multiphase fluid is produced from a well. The gas constituent and the oil constituent are separated from the multiphase fluid, the oil constituent having an undesirable viscosity. Both the gas constituent and the oil constituent are measured. Thereafter, at least a first portion of the gas constituent is injected into the oil constituent. The first portion of the gas constituent is mixed with the oil constituent such that the first portion of the gas constituent is dispersed into the oil constituent to form an oil/gas mixture having a viscosity that is lower than the undesirable viscosity of the oil constituent and a BTU content higher than the oil constituent.

11 Claims, 4 Drawing Sheets

DISPERSING SEPARATED HYDROCARBON GAS INTO SEPARATED OIL DURING SURFACE WELL TESTING FOR IMPROVED OIL MOBILITY

TECHNICAL FIELD OF THE INVENTION

This invention relates, in general, to equipment utilized in conjunction with operations performed in relation to subterranean wells and, in particular, to dispersing separated hydrocarbon gas into separated oil during surface well testing for improved oil mobility.

BACKGROUND OF THE INVENTION

Without limiting the scope of the present invention, its background will be described in relation to exploratory subterranean well operations, as an example.

In the search for oil reserves in unproven areas, exploratory wells are often drilled for the purpose of extracting geological, geophysical or geochemical information about an area with a view to discovering and exploiting new reserves. In such operations, after an oil or gas well has been drilled, it is desirable to determine the flow rates of the various constituents of the well fluid. For example, the well fluid may be a two-phase, three-phase or four-phase fluid including oil, gas, solids and water.

Typically, the well fluid stream is flowed from the well through a surface test tree at the wellhead. This fluid stream then passes through a choke manifold including one or more valves which are used to accurately throttle the flow from the well so that the fluid pressure downstream from the choke manifold is reduced. The fluid stream is then flowed into a processing facility including a heater and a separator, both sized to accommodate the appropriate flow. The heater is used to maintain the fluid stream at a temperature suitable to enable the desired fluid mobility. This is particularly important in fluid streams containing heavy oils, such as oils having a specific gravity below 22.3° as classified by the American Petroleum Institute. The separator separates the fluid into its constituents such as gas, oil and water constituents. The separated constituents are flowed out of the separator in individual lines. The flow rate of the constituent in each line is measured, so that the operator will know the relative amounts of each. After these measurements are made, the gas constituent is typically flared, the water constituent is directed to a treatment or disposal location and the oil constituent is pumped to a burner for elimination.

It has been found, however, that due to the high viscosity of the oil constituent, particularly in fluid streams having heavy oils, the mobility of the oil constituent may be unacceptably low to enable pumping to the burner. One way to improve the mobility of the oil constituent is to add a lighter hydrocarbon liquid, referred to herein as diesel, to the oil constituent to generate a mixture having a lower viscosity than the original oil constituent such that the thinned oil can be more easily transported to the burner. It has been found, however, that mixing diesel into the oil constituent is wasteful of the diesel as it is burned with the oil constituent without delivering any useful work. In addition, use of diesel for mixing with the oil constituent requires expensive transportation and storage of the diesel which is particularly significant when the exploratory well is drilled at a remote, inaccessible location.

Accordingly, a need has arisen for an apparatus and method for determining the flow rates of the constituent fluids in a multiphase well fluid stream from an exploratory well. A need has also arisen for such an apparatus and method that is operable to maintain suitable mobility of the oil constituent even in fluid streams having heavy oils while minimizing or eliminating the requirement of mixing diesel into the oil constituent.

SUMMARY OF THE INVENTION

The present invention disclosed herein is directed to a surface well testing facility for dispersing separated hydrocarbon gas into separated oil for improved oil mobility. The surface well testing facility of the present invention is operable to determine the flow rates of the constituent fluids of a multiphase well fluid stream. In addition, the surface well testing facility of the present invention is operable to maintain suitable mobility and achieve efficient combustion of the oil constituent even in fluid streams having heavy oils while minimizing or eliminating the requirement of mixing diesel into the oil constituent.

In one aspect, the present invention is directed to a method for improving oil mobility during surface well testing. The method involves producing a multiphase fluid from a well, separating a gas constituent and an oil constituent having an undesirable viscosity from the multiphase fluid, measuring the gas constituent and the oil constituent, injecting at least a first portion of the gas constituent into the oil constituent and dispersing the first portion of the gas constituent into the oil constituent to form an oil/gas mixture having a viscosity that is lower than the undesirable viscosity of the oil constituent.

The method may also include, separating a water constituent from the multiphase fluid, injecting the first portion of the gas constituent into the oil constituent upstream of a centrifugal pump, mixing the first portion of the gas constituent with the oil constituent at least partially within the centrifugal pump, injecting the first portion of the gas constituent into the oil constituent through at least one nozzle, injecting the first portion of the gas constituent into the oil constituent through at least one venturi type nozzle, injecting the gas constituent into the oil constituent proximate to an oil burner, injecting the first portion of the gas constituent into the oil constituent upstream of a centrifugal pump and injecting a remaining portion of the gas constituent into the oil constituent proximate to an oil burner, burning the oil constituent having the first portion of the gas constituent dispersed therein or flaring a remaining portion of the gas constituent that is not dispersed in the oil constituent.

In another aspect, the present invention is directed to a method for improving oil mobility during surface well testing. The method involves producing a multiphase fluid from a well, separating a gas constituent and an oil constituent having an undesirable viscosity from the multiphase fluid in a separator, measuring the gas constituent and the oil constituent, injecting at least a first portion of the gas constituent into the oil constituent upstream of a centrifugal pump, mixing the first portion of the gas constituent with the oil constituent in the centrifugal pump to disperse the first portion of the gas constituent into the oil constituent and form an oil/gas mixture having a viscosity that is lower than the undesirable viscosity of the oil constituent and burning the oil/gas mixture at an oil burner.

In a further aspect, the present invention is directed to a method for improving combustion efficiency of oil during surface well testing. The method involves producing a multiphase fluid from a well, separating a gas constituent and an oil constituent from the multiphase fluid in a separator, measuring the gas constituent and the oil constituent, injecting at least a first portion of the gas constituent into the oil constituent, dispersing the first portion of the gas constituent into the oil constituent to form an oil/gas mixture and burning the oil/gas mixture at an oil burner.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
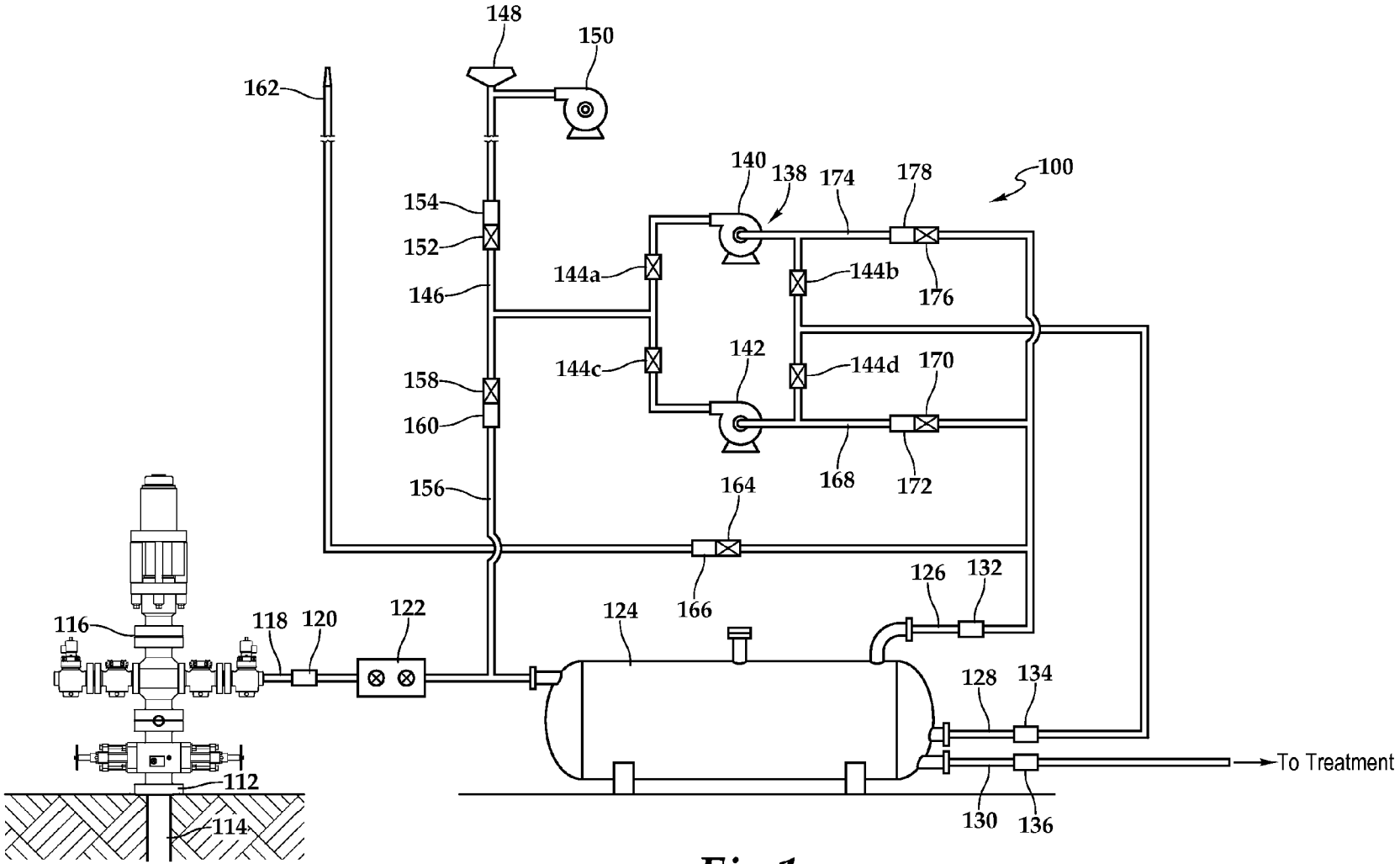
FIG. 1 is a schematic illustration of a surface well testing facility operable to disperse separated hydrocarbon gas into separated oil for improved oil mobility according to an embodiment of the present invention.

Referring initially to FIG. 1, therein is depicted a surface well testing facility operable to disperse separated hydrocarbon gas into separated oil from a multiphase well fluid according to an embodiment of the present invention that is schematically illustrated and generally designated 100. Surface well testing facility 100 includes a wellhead 112 positioned above a subterranean well 114. A surface test tree 116 is connected to wellhead 112. Surface test tree 116 includes a plurality of valves for controlling fluid flow into or out of well 114.

A flow line 118 extends from surface test tree 116 to transport a multiphase well fluid produced from well 114 for processing. In the illustrated embodiment, flow line 118 includes a well monitoring assembly 120 including, for example, access points for gauges, such as pressure sensors, temperature sensors, sand detection sensors, flow rate sensors, flow composition sensors and the like. In addition, flow line 118 includes a choke manifold 122 which includes one or more valves that are used to accurately throttle the flow from the well so that the fluid pressure downstream from choke manifold 122 is reduced to a desired pressure.

Downstream from choke manifold 122 is a separator 124 in which the various constituents of the well fluid are separated. In the illustrated embodiment, separator 124 is depicted as a system for handling a three-phase fluid; namely, a fluid having a gas constituent, an oil constituent and a water constituent. Separator 124 includes a gas line 126 discharging from the top of separator 124, an oil line 128 discharging from an intermediate portion of separator 124 and a water line 130 discharging near the bottom of separator 124. An orifice-type gas flow meter 132 is disposed in gas line 126, a volumetric oil flow meter 134 is disposed in oil line 128 and a volumetric water flow meter 136 is disposed in water line 130. Preferably, water line 130 is directed to a tank or other facility in which the water may be treated for later disposal.

In the illustrated embodiment, the oil constituent in oil line 128 is directed to a pumping facility 138 that is depicted as including two centrifugal pumps 140, 142. Pumps 140, 142 may be run in parallel or may be operated independently depending upon the operating configuration of valves 144*a-d*. Preferably, rotating impellers inside of pumps 140, 142 increase the pressure and flow rate of the oil constituent such that it can be transported in oil discharge line 146 to an oil burner 148 having suitable oil gun nozzles to enable burning of the oil constituent. Preferably, air is mixed with the oil constituent proximate to oil burner 148. The air is provided from an air injection system 150, which may inject the air tangentially to the oil constituent to create a swirling action therebetween and improve the dispersion of the air in the oil constituent. Alternatively or additionally, nozzles or other mechanical mixing elements may be used to further promote air dispersion in the oil constituent to improve the combustion efficiency of the mixture. Preferably, oil burner 148 is positioned at a distal end of a boom. In the illustrated embodiment, discharge line 146 includes flow control components such as a valve 152 and a regulator 154. Alternatively, the oil constituent may be returned to separator 124 via an oil bypass line 156 that includes flow control components such as a valve 158 and a regulator 160.

In the illustrated embodiment, the gas constituent in gas line 126 may be directed to a flare 162 through which the gas constituent is flared to the atmosphere. Preferably, gas line 126 includes flow control components such as a valve 164 and a regulator 166. Alternatively or additionally, the gas constituent in gas line 126 may be directed to a gas injection line 168 that includes flow control components such as a valve 170 and a regulator 172 and/or a gas injection line 174 that includes flow control components such as a valve 176 and a regulator 178. Specifically, depending upon the configuration of valves 164, 170 and 176, some or all of the gas constituent in gas line 126 may be directed flare 162, pump 140 and/or pump 142. As illustrated, gas injection line 168 injects the gas constituent into the oil constituent at a location upstream of pump 142 and preferably proximate to pump 142 at its inlet header. Likewise, gas injection line 174 injects the gas constituent into the oil constituent at a location upstream of pump 140 and preferably proximate to pump 140 at its inlet header. During the gas constituent injection process, valves 144*a-d* are configured to enable the desired mixing of the gas constituent with the oil constituent. For example, depending upon the volumes of the constituents, it may be desirable to close valves 144*a*, 144*b* and 176. In this configuration, the rotating impeller inside of pump 142 not only increases the pressure and flow rate of the oil constituent but also mixes the gas constituent with the oil constituent such that the gas constituent is dispersed into the oil constituent. Alternatively, the mixing and dispersing process could take place in pump 140 or, as another alternative, portions of both the gas constituent and the oil constituent could be directed to each of pumps 140 and 142 for mixing and dispersing.

The dispersing of the gas constituent into the oil constituent forms an oil/gas mixture having a viscosity that is lower than the undesirable viscosity of the oil constituent by creating a generally homogeneous mixture wherein the gas constituent may be entrained in or dissolved in the oil constituent or by creating a generally colloidal relationship between the gas constituent and the oil constituent. Reducing the viscosity of the oil constituent by dispersing the gas constituent therein reduces or eliminates the need to add diesel into the oil constituent to maintain suitable mobility of the oil constituent, particularly in a fluid stream having heavy oils.

Even though FIG. 1 has depicted pumping facility 138 as having a particular number of pumps, those skilled in the art will recognize that a pumping facility for increasing the pressure and flow rate of the oil constituent and mixing the gas constituent with the oil constituent could have other numbers of pumps both greater than and less than that which is shown without departing from the principles of the present invention.

Figure 2:
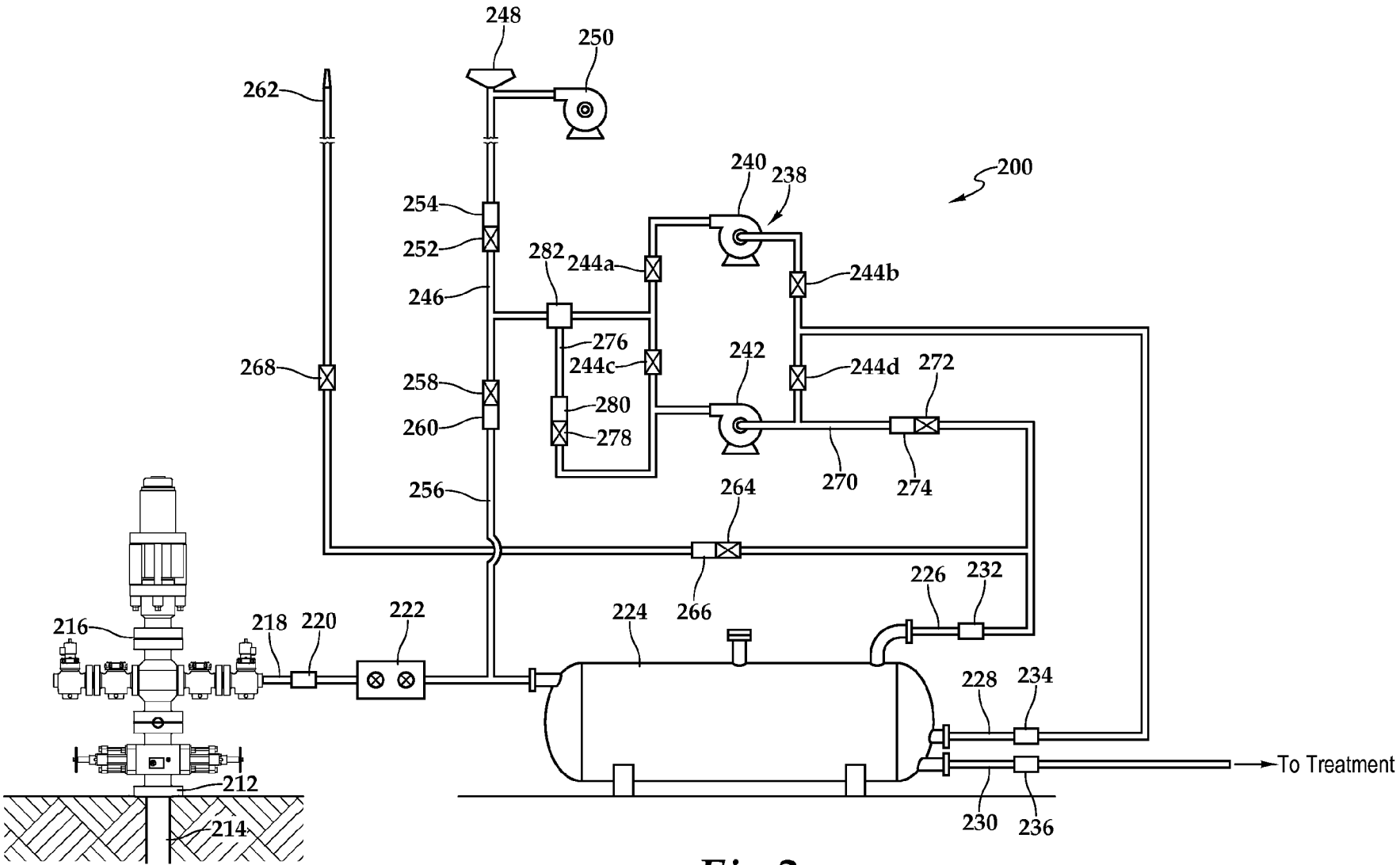
FIG. 2 is a schematic illustration of a surface well testing facility operable to disperse separated hydrocarbon gas into separated oil for improved oil mobility according to a second embodiment of the present invention.

Referring next to FIG. 2, therein is depicted a surface well testing facility operable to disperse separated hydrocarbon gas into separated oil from a multiphase well fluid according to an embodiment of the present invention that is schematically illustrated and generally designated 200. Surface well testing facility 200 includes a wellhead 212 positioned above a subterranean well 214. A surface test tree 216 is connected to wellhead 212. A flow line 218 extends from surface test tree 216 to transport a multiphase well fluid produced from well 214 for processing. In the illustrated embodiment, flow line 218 includes a well monitoring assembly 220 and a choke manifold 222.

Downstream from choke manifold 222 is a separator 224 in which the various constituents of the well fluid are separated. In the illustrated embodiment, separator 224 is depicted as a system for handling a three-phase fluid; namely, a fluid having a gas constituent, an oil constituent and a water constituent. Separator 224 includes a gas line 226 discharging from the top of separator 224, an oil line 228 discharging from an intermediate portion of separator 224 and a water line 230 discharging near the bottom of separator 224. An orifice-type gas flow meter 232 is disposed in gas line 226, a volumetric oil flow meter 234 is disposed in oil line 228 and a volumetric water flow meter 236 is disposed in water line 230. Preferably, water line 230 is directed to a tank or other facility in which the water may be treated for later disposal.

In the illustrated embodiment, the oil constituent in oil line 228 is directed to a pumping facility 238 that is depicted as including two centrifugal pumps 240, 242 which may be run in parallel or may be operated independently depending upon the operating configuration of valves 244*a-d*. Preferably, rotating impellers inside of pumps 240, 242 increase the pressure and flow rate of the oil constituent such that it can be transported in oil discharge line 246 to an oil burner 248, positioned at a distal end of a boom, having suitable oil gun nozzles to enable burning of the oil constituent. Preferably, air from an air injection system 250 is mixed with the oil constituent proximate to oil burner 248. In the illustrated embodiment, discharge line 246 includes flow control components such as a valve 252 and a regulator 254. Alternatively, the oil constituent may be returned to separator 224 via an oil bypass line 256 that includes flow control components such as a valve 258 and a regulator 260.

In the illustrated embodiment, the gas constituent in gas line 226 is directed to a flare 262 through which the gas constituent is flared to the atmosphere. Preferably, gas line 226 includes flow control components such as a valve 264, a regulator 266 and a valve 268. Alternatively or additionally, the gas constituent in gas line 226 may be directed to gas injection line 270 that includes flow control components such as a valve 272 and a regulator 274. Depending upon the configuration of valves 264, 268 and 272, some or all of the gas constituent in gas line 226 may be directed flare 262 and/or pump 242. As illustrated, gas injection line 270 injects the gas constituent at a location upstream of pump 242 and preferably proximate to pump 242 at its inlet header. During the gas constituent injection process, valves 244*c* and 244*d* may be closed such that pump 142 increases the pressure and flow rate of the gas constituent while pump 240 increases the pressure and flow rate of the oil constituent. The pressurized gas constituent is directed to a gas injection line 276 that preferably includes flow control components such as a valve 278 and a regulator 280.

As illustrated, gas injection line 276 injects the gas constituent into the oil constituent at a location downstream of pumping facility 238. In the illustrated embodiment, gas injection line 276 directs the gas constituent into the oil constituent at mixer section 282. Mixer section 282 preferably includes one or more nozzles such as venturi nozzles having converging/diverging profiles which aid in the mixing of the gas constituent with the oil constituent such that the gas constituent is dispersed into the oil constituent. Mixer section 282 may also include vanes or other mechanical mixing elements to further aid in dispersing the gas constituent into the oil constituent. As stated above, dispersing the gas constituent into the oil constituent forms an oil/gas mixture having a viscosity that is lower than the undesirable viscosity of the oil constituent which reduces or eliminates the need to add diesel into the oil constituent to maintain suitable mobility of the oil constituent, particularly in a fluid stream having heavy oils.

Figure 3:
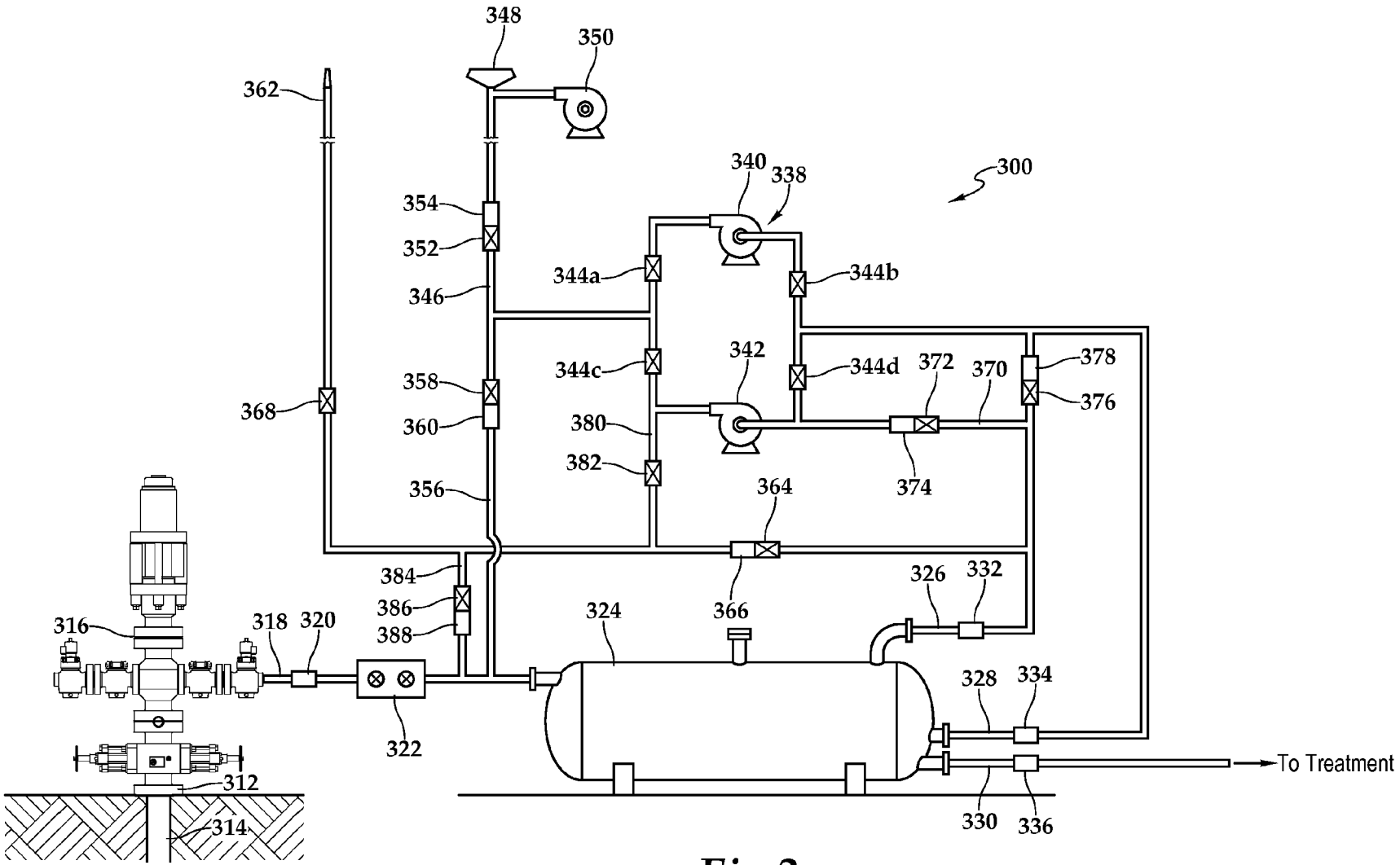
FIG. 3 is a schematic illustration of a surface well testing facility operable to disperse separated hydrocarbon gas into separated oil for improved oil mobility according to a third embodiment of the present invention.

Referring now to FIG. 3, therein is depicted a surface well testing facility operable to disperse separated hydrocarbon gas into separated oil from a multiphase well fluid according to an embodiment of the present invention that is schematically illustrated and generally designated 300. Surface well testing facility 300 includes a wellhead 312 positioned above a subterranean well 314. A surface test tree 316 is connected to wellhead 312. A flow line 318 extends from surface test tree 316 to transport a multiphase well fluid produced from well 314 for processing. In the illustrated embodiment, flow line 318 includes a well monitoring assembly 320 and a choke manifold 322.

Downstream from choke manifold 322 is a separator 324 in which the various constituents of the well fluid are separated. In the illustrated embodiment, separator 324 is depicted as a system for handling a three-phase fluid; namely, a fluid having a gas constituent, an oil constituent and a water constituent. Separator 324 includes a gas line 326 discharging from the top of separator 324, an oil line 328 discharging from an intermediate portion of separator 324 and a water line 330 discharging near the bottom of separator 324. An orifice-type gas flow meter 332 is disposed in gas line 326, a volumetric oil flow meter 334 is disposed in oil line 328 and a volumetric water flow meter 336 is disposed in water line 330. Preferably, water line 330 is directed to a tank or other facility in which the water may be treated for later disposal.

In the illustrated embodiment, the oil constituent in oil line 328 is directed to a pumping facility 338 that is depicted as including two centrifugal pumps 340, 342 which may be run in parallel or may be operated independently depending upon the operating configuration of valves 344*a-d*. Preferably, rotating impellers inside of pumps 340, 342 increase the pressure and flow rate of the oil constituent such that it can be transported in oil discharge line 346 to an oil burner 348 positioned at a distal end of a boom, having suitable oil gun nozzles to enable burning of the oil constituent. Preferably, air from an air injection system 350 is mixed with the oil constituent proximate to oil burner 348. In the illustrated embodiment, discharge line 346 includes flow control components such as a valve 352 and a regulator 354. Alternatively, the oil constituent may be returned to separator 324 via an oil bypass line 356 that includes flow control components such as a valve 358 and a regulator 360.

In the illustrated embodiment, the gas constituent in gas line 326 is directed to a flare 362 through which the gas constituent is flared to the atmosphere. Preferably, gas line 326 includes flow control components such as a valve 364, a regulator 366 and a valve 368. Alternatively or additionally, the gas constituent in gas line 326 may be directed to gas injection line 370 that includes flow control components such as a valve 372 and a regulator 374. As illustrated, gas injection line 370 injects the gas constituent at a location upstream of pump 342 and preferably proximate to pump 342 at its inlet header. As another alternative, the gas constituent in gas line 326 may be injected into the oil constituent in oil line 328 downstream of flow control components such as a valve 376 and a regulator 378. Depending upon the configuration of valves 364, 372 and 376, some or all of the gas constituent in gas line 326 may be directed to flare 362, pump 342 and/or pump 340.

For example, if valves 364 and 372 are closed, the gas constituent is injected into the oil constituent at a location upstream of pumping facility 338. In this configuration, the rotating impellers inside of pumps 340, 342 not only increase the pressure and flow rate of the oil constituent but also mix the gas constituent with the oil constituent such that the gas constituent is dispersed into the oil constituent. Dispersing the gas constituent into the oil constituent forms an oil/gas mixture having a viscosity that is lower than the undesirable viscosity of the oil constituent which reduces or eliminates the need to add diesel into the oil constituent to maintain suitable mobility of the oil constituent, particularly in a fluid stream having heavy oils.

In addition, in certain installations it may be desirable to increase the mobility of the multiphase fluid as it is being transported in flow line 318. In the past, this operation could be performed by passing the multiphase fluid through a heater typically positioned between choke manifold 322 and separator 324. In the present invention, however, the need for the heater can be reduced or eliminated by injecting a portion of the gas constituent into the multiphase fluid. As illustrated, at least a portion of the gas constituent may be directed to gas bypass line 380 that includes a valve 382 and gas bypass line 384 including flow control components such a valve 386 and a regulator 388. Specifically, with proper configuration of valves 344*c*, 344*d*, 364, 376, 368, 372, 382 and 386, all or a portion of the gas constituent from gas line 326 may be routed through pump 342 then routed back to flow line 318 to increase the mobility of the multiphase fluid therein.

Figure 4:
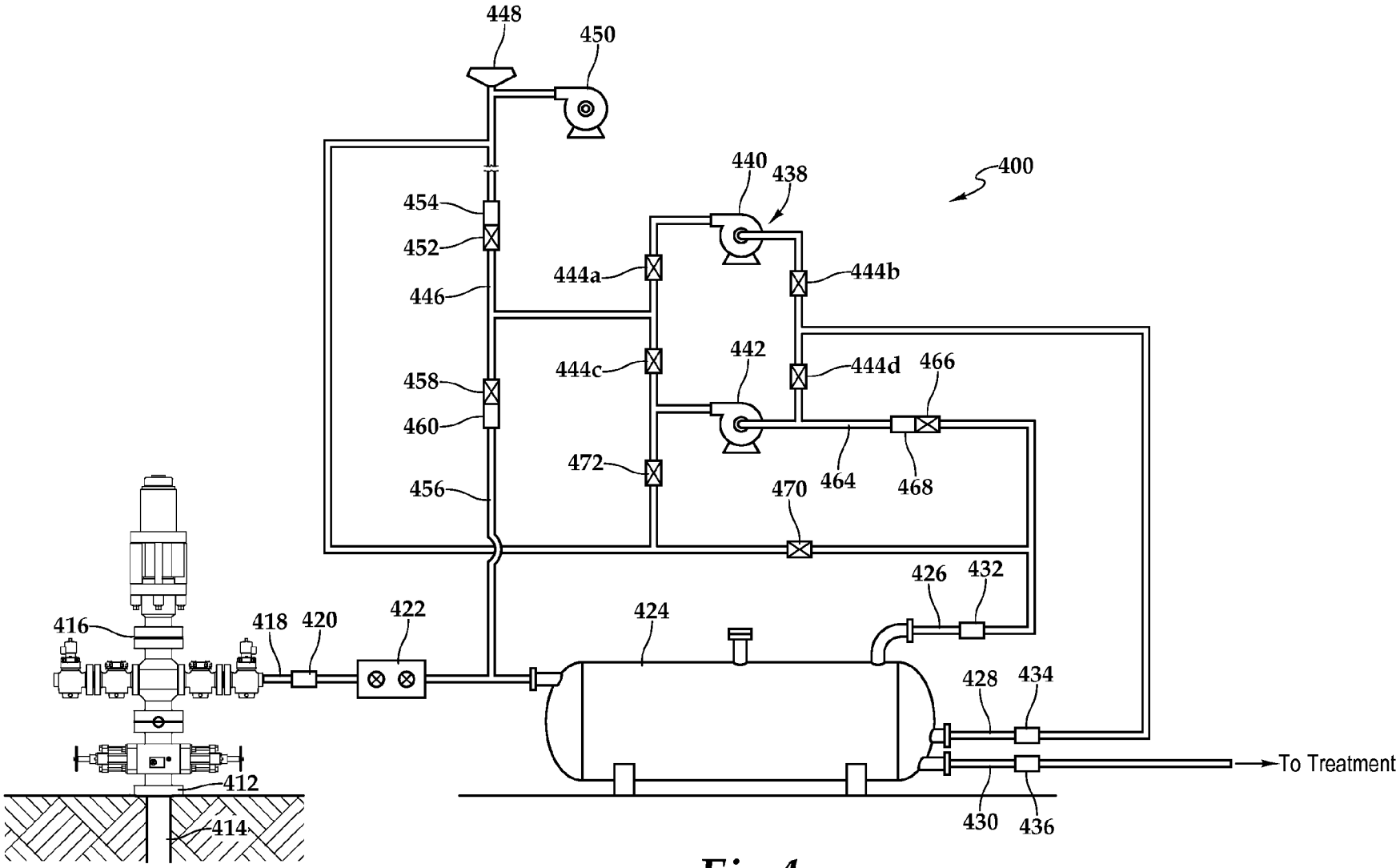
FIG. 4 is a schematic illustration of a surface well testing facility operable to disperse separated hydrocarbon gas into separated oil for improved oil mobility according to a fourth embodiment of the present invention.

Referring next to FIG. 4, therein is depicted a surface well testing facility operable to disperse separated hydrocarbon gas into separated oil from a multiphase well fluid according to an embodiment of the present invention that is schematically illustrated and generally designated 400. Surface well testing facility 400 includes a wellhead 412 positioned above a subterranean well 414. A surface test tree 416 is connected to wellhead 412. A flow line 418 extends from surface test tree 416 to transport a multiphase well fluid produced from well 414 for processing. In the illustrated embodiment, flow line 418 includes a well monitoring assembly 420 and a choke manifold 422.

Downstream from choke manifold 422 is a separator 424 in which the various constituents of the well fluid are separated. In the illustrated embodiment, separator 424 is depicted as a system for handling a three-phase fluid; namely, a fluid having a gas constituent, an oil constituent and a water constituent. Separator 424 includes a gas line 426 discharging from the top of separator 424, an oil line 428 discharging from an intermediate portion of separator 424 and a water line 430 discharging near the bottom of separator 424. An orifice-type gas flow meter 432 is disposed in gas line 426, a volumetric oil flow meter 434 is disposed in oil line 428 and a volumetric water flow meter 436 is disposed in water line 430. Preferably, water line 430 is directed to a tank or other facility in which the water may be treated for later disposal.

In the illustrated embodiment, the oil constituent in oil line 428 is directed to a pumping facility 438 that is depicted as including two centrifugal pumps 440, 442 which may be run in parallel or may be operated independently depending upon the operating configuration of valves 444*a-d*. Preferably, rotating impellers inside of pumps 440, 442 increase the pressure and flow rate of the oil constituent such that it can be transported in oil discharge line 446 to an oil burner 448, positioned at a distal end of a boom, having suitable oil gun nozzles to enable burning of the oil constituent. Preferably, air from an air injection system 450 is mixed with the oil constituent proximate to oil burner 448. In the illustrated embodiment, discharge line 446 includes flow control components such as a valve 452 and a regulator 454. Alternatively, the oil constituent may be returned to separator 424 via an oil bypass line 456 that includes flow control components such as a valve 458 and a regulator 460.

In the illustrated embodiment, all or a portion of the gas constituent in gas line 426 is directed to oil burner 448 through which the gas constituent is burned with the oil constituent. Preferably, the gas constituent is injected tangentially into the oil constituent proximate to oil burner 448 such as at a location near the bottom of the boom. By tangentially directing the gas constituent into the oil constituent, improved dispersion of the gas constituent is achieved due to the swirling action therebetween. Alternatively or additionally, one or more nozzles such as venturi nozzles having converging/diverging profiles may be used to inject the gas constituent into the oil constituent to aid in the dispersion of the gas constituent into the oil constituent. Also, vanes or other mechanical mixing elements may be used to aid in the dispersion of the gas constituent into the oil constituent. Adding the gas constituent into the oil constituent not only improves the mobility of the oil constituent by forming an oil/gas mixture having a viscosity that is lower than the undesirable viscosity of the oil constituent but also creates an oil/gas mixture having a BTU content that is higher than the BTU content of the oil constituent enabling a more efficient flame front for complete combustion of the oil/gas mixture.

For example, all or a portion of the gas constituent from gas line 426 may be directed to gas injection line 464 that includes flow control components such as a valve 466 and a regulator 468. With proper configuration of valves 444*a-d*, 466, 470 and 472, high pressure gas is directed to gas line 426 downstream of valve 470 and routed to oil burner 448. Alternatively, as described above, all or a portion of the gas constituent may be injected into the oil constituent at a location upstream of pump 442 such that the rotating impeller inside of pump 442 not only increase the pressure and flow rate of the oil constituent but also mixes the gas constituent with the oil constituent such that the gas constituent is dispersed into the oil constituent. Dispersing the gas constituent into the oil constituent forms an oil/gas mixture having a viscosity that is lower than the undesirable viscosity of the oil constituent which reduces or eliminates the need to add diesel into the oil constituent to maintain suitable mobility of the oil constituent, particularly in a fluid stream having heavy oils.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for improving oil mobility during surface well testing, the method comprising:

producing a multiphase fluid from a well;

separating a hydrocarbon gas constituent and an oil constituent having a first viscosity from the multiphase fluid in a surface well testing facility;

measuring the separated hydrocarbon gas constituent and the separated oil constituent;

injecting a first portion of the separated hydrocarbon gas constituent into the separated oil constituent;

dispersing the first portion of the separated hydrocarbon gas constituent into the separated oil constituent to form an oil/hydrocarbon gas mixture having a second viscosity that is lower than the first viscosity of the separated oil constituent, thereby improving oil mobility during surface well testing;

flaring a second portion of the separated hydrocarbon gas constituent;

injecting air into the oil/hydrocarbon gas mixture upstream of an oil burner; and burning the oil/hydrocarbon gas mixture at the oil burner.

2. The method as recited in claim 1 wherein separating the hydrocarbon gas constituent and the oil constituent from the multiphase fluid further comprises separating a water constituent from the multiphase fluid.

3. The method as recited in claim 1 wherein injecting the first portion of the separated hydrocarbon gas constituent into the separated oil constituent further comprises injecting the first portion of the separated hydrocarbon gas constituent into the separated oil constituent upstream of a centrifugal pump.

4. The method as recited in claim 3 wherein dispersing the first portion of the separated hydrocarbon gas constituent into the separated oil constituent occurs at least partially within the centrifugal pump.

5. The method as recited in claim 1 wherein injecting the first portion of the separated hydrocarbon gas constituent into the separated oil constituent further comprises injecting the first portion of the separated hydrocarbon gas constituent into the separated oil constituent through at least one nozzle.

6. The method as recited in claim 5 wherein injecting the first portion of the separated hydrocarbon gas constituent into the separated oil constituent through at least one nozzle further comprises injecting the first portion of the separated hydrocarbon gas constituent into the separated oil constituent through at least one venturi type nozzle.

7. The method as recited in claim 1 wherein injecting the first portion of the separated hydrocarbon gas constituent into the separated oil constituent further comprises injecting the separated hydrocarbon gas constituent into the separated oil constituent proximate to an oil burner.

8. The method as recited in claim 1 wherein injecting the first portion of the separated hydrocarbon gas constituent into the separated oil constituent further comprises injecting the first portion of the separated hydrocarbon gas constituent into the separated oil constituent upstream of a centrifugal pump and injecting a remaining portion of the separated hydrocarbon gas constituent into the separated oil constituent proximate to an oil burner.

9. A method for improving oil mobility during surface well testing, the method comprising:

producing a multiphase fluid from a well;

separating a hydrocarbon gas constituent and an oil constituent having a first viscosity from the multiphase fluid in a separator in a surface well testing facility;

measuring the separated hydrocarbon gas constituent and the separated oil constituent;

injecting a first portion of the separated hydrocarbon gas constituent into the separated oil constituent upstream of a centrifugal pump;

mixing the first portion of the separated hydrocarbon gas constituent with the separated oil constituent in the centrifugal pump to disperse the first portion of the separated hydrocarbon gas constituent into the separated oil constituent and form an oil/hydrocarbon gas mixture having a viscosity that is lower than the first viscosity of the separated oil constituent, thereby improving oil mobility during surface well testing;

flaring a second portion of the separated hydrocarbon gas constituent;

injecting air into the oil/hydrocarbon gas mixture upstream of an oil burner; and burning the oil/hydrocarbon gas mixture at the oil burner.

10. The method as recited in claim 9 wherein separating the hydrocarbon gas constituent and the oil constituent from the multiphase fluid in a separator further comprises separating a water constituent from the multiphase fluid.

11. The method as recited in claim 9 further comprising injecting a remaining portion of the separated hydrocarbon gas constituent into the separated oil constituent proximate to the oil burner.

* * * * *